US006125779A

United States Patent [19]

Czipri

[11] Patent Number: 6,125,779

[45] Date of Patent: Oct. 3, 2000

[54] BOAT CLEAT

[75] Inventor: John Czipri, Palm Harbor, Fla.

[73] Assignee: Accon Marine, Inc., Clearwater, Fla.

[21] Appl. No.: 09/259,352

[22] Filed: Mar. 1, 1999

[51] Int. Cl.[7] ..... B63B 21/04

[52] U.S. Cl. ..... 114/218; 410/107

[58] Field of Search ..... 114/218, 219; 410/107

[56] References Cited

U.S. PATENT DOCUMENTS

| | | | |
|---|---|---|---|
| 4,672,909 | 6/1987 | Sweetsir | 114/218 |
| 4,809,634 | 3/1989 | Czipri | 114/218 |
| 4,890,566 | 1/1990 | Morris | 114/218 |
| 4,945,849 | 8/1990 | Morris et al. | 114/218 |
| 5,004,388 | 4/1991 | Harris | 410/107 |
| 5,106,248 | 4/1992 | Harris | 410/107 |
| 5,301,627 | 4/1994 | Czipri | 114/218 |
| 5,535,694 | 7/1996 | Czipri | 114/218 |
| 5,983,820 | 11/1999 | Whitley | 114/218 |

*Primary Examiner*—S. Joseph Morano
*Assistant Examiner*—Lars A. Olson
*Attorney, Agent, or Firm*—Harold D. Shall

[57] ABSTRACT

A cleat assembly including a housing and a securing members mounted therein for movement between operative and inoperative positions and a spring loaded poppit carried by the securing members and registerable with detents carried by the housing. The detents having openings therein confluent with the surface of the housing.

1 Claim, 2 Drawing Sheets

BOAT CLEAT

BACKGROUND OF THE INVENTION

This invention relates generally to cleats having a depressed inoperative position and which are capable of being raised to an upright operative position and more particularly to a cleat wherein the means for holding the cleat in its positions is easily cleaned of dirt, sand, deposits and the like.

Cleats having a depressed inoperative position which can be moved to an operative position are well known in the art; such as seen in U.S. Pat. Nos. 5,535,694; 5,301,627, 4,809,634. In U.S. Pat. No. 5,535,694, a poppit 32 is biased by a spring 33 to engage detents in the shank 22. In this structure, if sea water deposits are accumulated on the poppits or the spring, operation of the poppit can be inhibited. In order to clear such deposits from the poppit area, the cleat must either be dissembled or the screw 34 and spring 33 removed to obtain access to the poppit.

It is, therefore, an object of this invention to provide a cleat with multiple positions and a spring loaded poppit for securing such positions, wherein the poppit can be accessed without dissembling the cleat.

It is another object of this invention to provide such a cleat wherein the poppit of the cleat may be accessed for cleaning from outside the cleat structure without removing any parts of the cleat.

SUMMARY OF THE INVENTION

A cleat which has a raised operative position and a depressed inoperative position includes a first movable portion to which a line may be secured when in an operative position and a second portion in the form of a housing which can receive the first portion in an inoperative position and which allows the first portion to move to its operative position. Spring loaded poppits carried by the first portion engage detents in the housing portion of the second member. Alternative detents are provided; one for the operative position and one for the depressed inoperative position. These poppits are carried in blind openings in the first portion and are operatively engageable with detents in the housing. The housing detents each has an opening confluent therewith, which opening can be accessed from outside of the housing and allows entry thereinto by a suitable tool, such as a screwdriver, which tool can manipulate the detent area thereby to clean it.

DETAILED DESCRIPTION OF A PREFERRED EMBODIMENT

Figure 1:
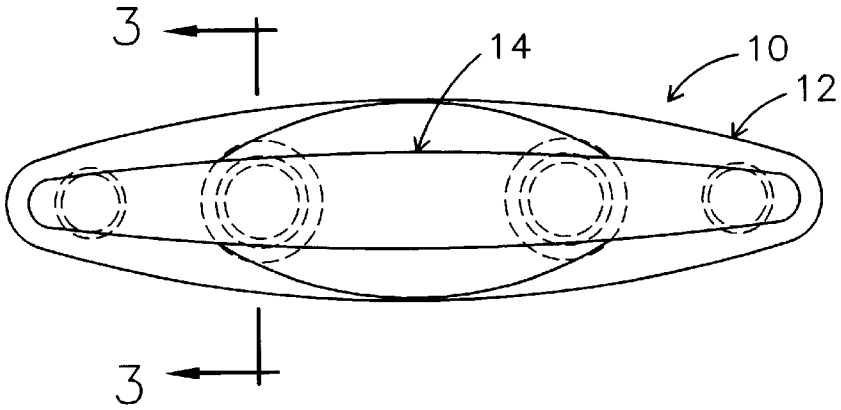
FIG. 1 is a plan view of a cleat according to this invention.
Figure 2:
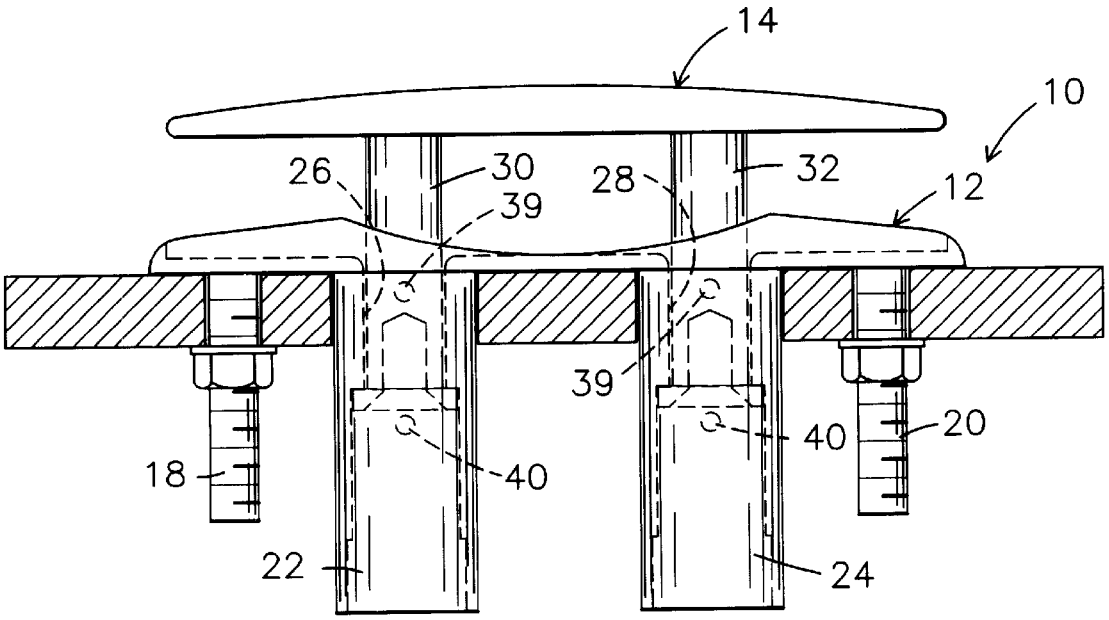
FIG. 2 is a side elevational view of the Cleat of FIG. 1 mounted a boat hull shown fragmentarily.
Figure 3:
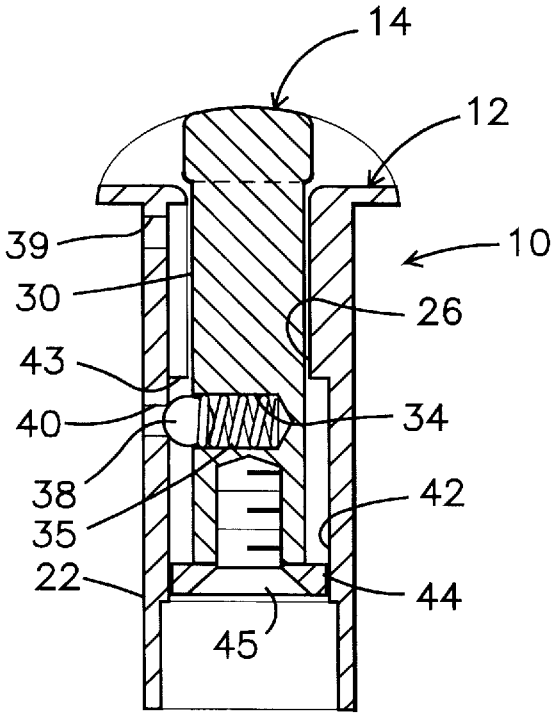
FIG. 3 is a cross sectional view taken along the lines 3—3 in FIG. 1 ith the cleat in its depressed and inoperative position.
Figure 4:
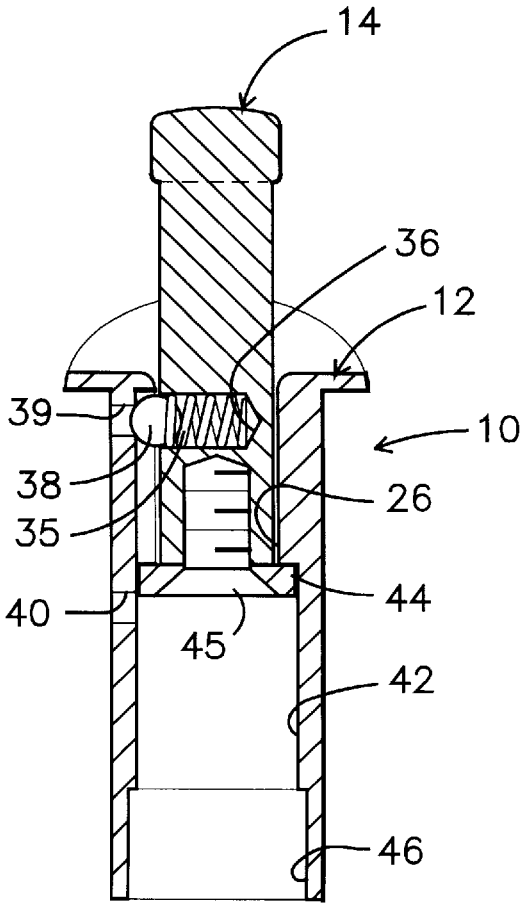
FIG. 4 is a view like FIG. 3 with the cleat in its raised operative position.

A boat cleat assembly shown generally at 10 includes a base or housing member 12 and a securing portion 14 of the cleat 10 which has a raised operative position as seen in FIGS. 2 and 4 and a depressed inoperative position as seen in FIG. 3. The housing member 12 has four members secured thereto and depend therefrom, namely, a pair of laterally spaced mounting bolts 18 and 20 and a pair of cylindrical receiving members 22 and 24.

The receiving members 22 and 24 each has a vertically extending receiving opening therein, 26 and 28 respectively, which openings receive, respectively, a leg 30 and 32 of the securing portion 14.

The cross section of the legs 30 and 32 register with the cross section of the receiving members 22 and 24 and are received therein for relative axial movement. Referring to FIGS. 3 and 4, a blind, laterally extending opening 34 is formed in each of the legs 30 and 32, and received in each opening 34 is a coiled compressive spring 35, which engages the bottom 36 of the opening 34, and an inner portion of a poppit 38. The outer portion of the poppit 38 is receivable in an upper opening or detent 39 in the receiving members when the member 14 is in its operative raised position and is receivable in a lower opening or detent 40 when the member 14 is disposed in its depressed inoperative position. Each of the openings 39 and 40 extends through the receiving member to open at the outer surface thereof so as to be confluent with the inner portion thereof and accessible to a cleaning instrument being inserted thereinto to move and clean the poppit 38 received in the opening and to flex the spring 35.

A counterbore 42 extends into the receiving members from the bottom thereof to end in a shoulder 43 which is engageable with a washer 44 secured to the bottom of each leg by a screw 45, which shoulder engages the washer 44 when the securing portion is in its raised position to thereby limit the upper movement thereof. A second counter bore 46 is formed at the lower open end of the receiving member wherein, if desired, a drain line (not shown) may be inserted to drain away, to a suitable location, any water that may enter the receiving member.

Although the above description elates to a presently preferred embodiment, numerous modifications may be made therein without departing from the scope of this invention as defined in the following claims.

What is claimed is:

1. A cleat assembly including a housing member and a securing member, said housing member having an upper surface and a pair of spaced receiving members depending therefrom with each receiving member having a receiving opening therein and with the securing member having leg members extending into said receiving members, and spring loaded poppit means acting between said receiving members and said leg member received therein, characterized in that, a) said poppit means comprises a spring loaded poppit, a blind opening, a spring and a detent, with
   1) said blind opening being in said leg members,
   2) said spring being in said blind opening,
   3) said poppit having an inner portion engaging said spring within said blind opening, and
   4) said poppit having an outer portion engageable with said detent, and
   5) said detents being in said receiving member, and b) each of said receiving members having an access opening confluent with said detent therein, and said access opening extends from said detent to the surface of said receiving member whereby said detent and poppit can be accessed by a tool through said access opening.

* * * * *